US006213043B1

(12) United States Patent
Daviknes

(10) Patent No.: US 6,213,043 B1
(45) Date of Patent: Apr. 10, 2001

(54) METHOD AND DEVICE FOR COUNTERACTING OF HEELING OF A VESSEL

(75) Inventor: Morten Daviknes, Oslo (NO)

(73) Assignee: Kvaerner Maritime AS, Lysaker (NO)

( * ) Notice: Subject to any disclaimer, the term of this patent is extended or adjusted under 35 U.S.C. 154(b) by 0 days.

(21) Appl. No.: 09/341,871

(22) PCT Filed: Feb. 25, 1998

(86) PCT No.: PCT/NO98/00058

§ 371 Date: Jul. 19, 1999

§ 102(e) Date: Jul. 19, 1999

(87) PCT Pub. No.: WO98/38081

PCT Pub. Date: Sep. 3, 1998

(30) Foreign Application Priority Data

Feb. 28, 1997 (NO) ..... 19970952

(51) Int. Cl.[7] ..... B63B 39/03
(52) U.S. Cl. ..... 114/125; 89/1.8; 114/121
(58) Field of Search ..... 114/121, 122, 114/125; 89/1.8, 1.809

(56) References Cited

U.S. PATENT DOCUMENTS

| | | | | |
|---|---|---|---|---|
| 2,338,147 | | 1/1944 | von den Steinen . | |
| 3,160,135 | * | 12/1964 | De Vries | 114/125 |
| 4,207,828 | | 6/1980 | Horowitz et al. . | |
| 4,747,334 | * | 5/1988 | Kuriiwa | 89/1.802 |
| 4,916,999 | * | 4/1990 | Palmer et al. | 89/1.815 |
| 5,042,358 | * | 8/1991 | Kuriiwa | 89/1.8 |
| 5,191,162 | * | 3/1993 | Czimmek | 89/1.802 |
| 5,908,999 | * | 6/1999 | Kristensen et al. | 89/1.801 |
| 5,918,306 | * | 6/1999 | Kristensen et al. | 89/1.801 |
| 5,932,830 | * | 8/1999 | Kristensen et al. | 89/1.801 |

FOREIGN PATENT DOCUMENTS

| | | | | |
|---|---|---|---|---|
| 1213853 | | 11/1970 | (GB) . | |
| 1468786 | | 3/1977 | (GB) . | |
| 2162482 | | 2/1986 | (GB) . | |
| 57-104491 | * | 6/1982 | (JP) | 114/121 |

OTHER PUBLICATIONS

Japanese Abstract: JPA–58–8490, Jan. 18, 1983.
Japanese Abstract: JPA–62–113687, May 25, 1987.
Japanese Abstract: JPA–58–185392, Oct. 29, 1983.
Japanese Abstract: JPA–62–55289, Mar. 10, 1987.

* cited by examiner

*Primary Examiner*—Sherman Basinger
(74) *Attorney, Agent, or Firm*—Birch, Stewart, Kolasch & Birch, LLP.

(57) ABSTRACT

A method for counteracting heeling of a vessel due to a movement of first masses on the vessel, by means of movement of second masses thereon, which movements create respective static movements upon the vessel's center of gravity. The movement of the second masses is performed synchronously with the movement of the first masses by ensuring that the static movement which is generated by the movement of the second masses continuously and completely counteracts the static movement as a result of the movement of the first masses. A device is set forth for implementing the method.

5 Claims, 2 Drawing Sheets

METHOD AND DEVICE FOR COUNTERACTING OF HEELING OF A VESSEL

This application is the national phase under 35 § 371 PCT International Application No. PCT/NO98/0058 which has an International filing date of Feb. 25, 1998, which designated the United States of America.

BACKGROUND OF THE INVENTION

1. Field of the Invention

The invention concerns a method for counteracting heeling of a sea-going vessel due to a movement of first masses on the vessel, by means of movement of second masses thereon, which movements create respective static moments about the vessel's centre of gravity.

2. Description Background Art

From the prior art as illustrated in FIG. 1, it is known that semi-submersible platform 100 can be employed as support structure for a rocket 101 which is to be launched, e.g., in order to place a satellite in an orbit around the earth. In this connection some of the preparation work for the rocket 101 is performed while it is located lying in a hangar, i.e. while the rocket's longitudinal axis extends horizontally. The rocket with the mounted satellite is then transported out of the hangar to a launching site on the platform 100 where the rocket 101 is raised to a standing position which is illustrated in FIG. 1, in which its longitudinal axis extends vertically, whereupon fuel 102, i.e. first masses, is pumped from tanks 103 on board the platform 100 to tanks 104 on board the rocket 101 by means of a pump 105, i.e. a first device for movement of the first masses. The pump 105 may be connected with a control device through an electrical conduit 106. The rocket 101 is then launched.

In a rocket of this type, its height is relatively great in relation to the diameter of its rear end section whereby it rests on the launch site, and in the event of substantial heeling there is a risk that it may overturn. However, minor heeling must also be avoided, since the hull of the rocket may be overloaded. For example, the heeling should not exceed 0.5 degrees. There is a special need to monitor the heeling when rocket fuel is being pumped on board the rocket from tanks in the platform, since large quantities of fuel are involved.

For controlling the platform's draught, the use is known of a ballast device comprising tanks from which sea water can be filled or emptied. For compensation of a heeling of the platform, it is similarly known that by means of the same ballast device sea water can be pumped from one tank on board the platform to another. This filling and emptying can be performed by means of suitable pumps, valves, etc. However, the angle of heeling is established before, e.g., any heeling compensation takes place.

If a standing rocket as described above is located on a platform of this type, and the rocket is being filled with fuel, an inadmissably high degree of heeling and reduction of the rocket's stability may therefore occur before any compensation of the heeling can take place, nor can the possibility be overlooked that the rocket's stability may be affected by additional forces as a result of wind and waves.

SUMMARY AND OBJECTS OF THE INVENTION

The object of the invention is to provide a method and a device as mentioned in the introduction, whereby the above-mentioned disadvantages can be avoided and which is not encumbered by the above-mentioned disadvantages.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
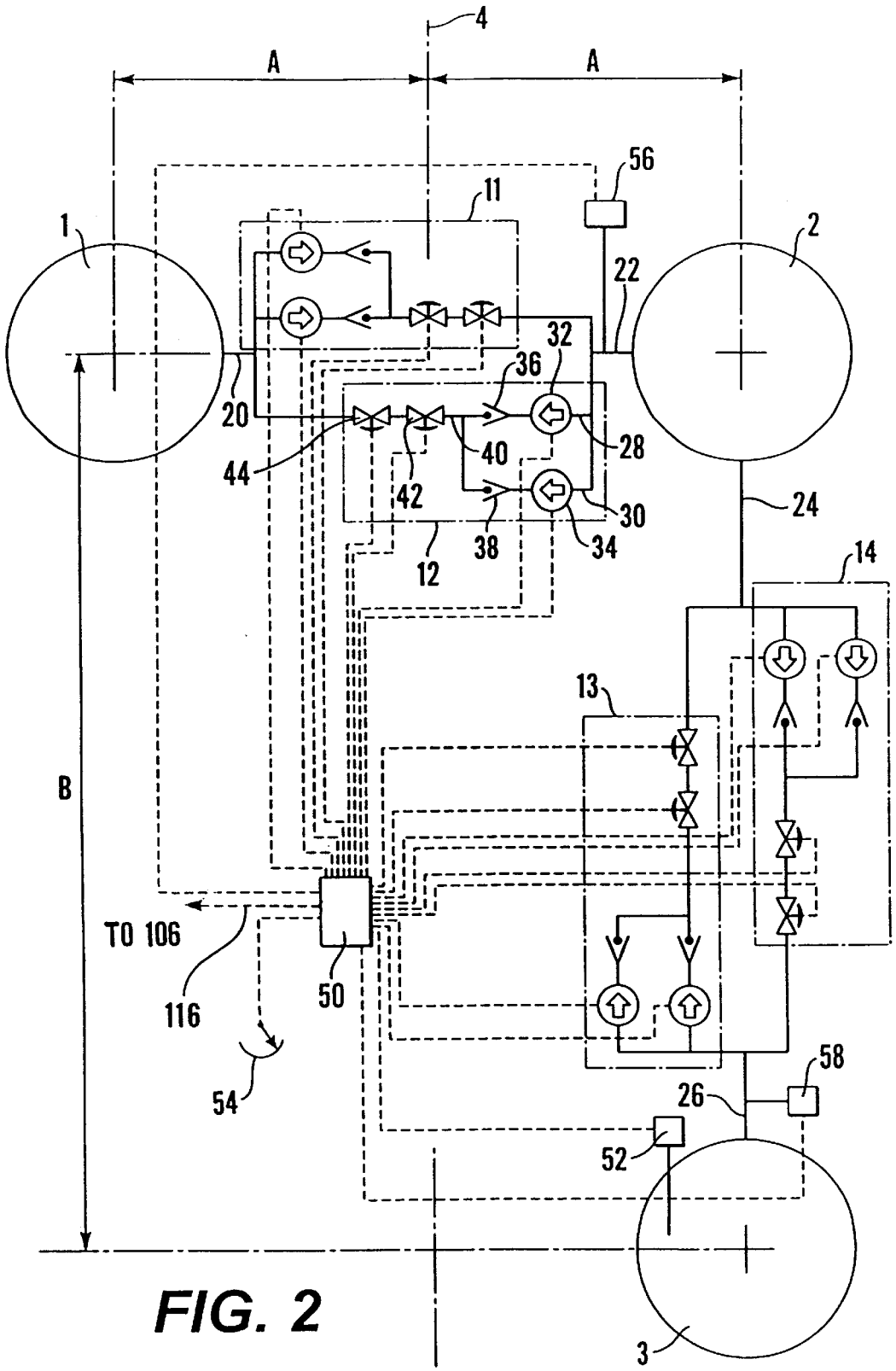
FIG. 2 is a schematic top view of a piping arrangement for a device according to the invention.

As illustrated in FIG. 2, on the left side of a longitudinal axis 4 of a seagoing vessel such as an offshore platform, there is provided a first tank 1, which is placed and designed in such a manner that its centre of gravity is constantly, i.e. during every stage of filling, located at a distance A from the longitudinal axis 4, assuming that the platform's centre of gravity is located on the longitudinal axis 4 or in a vertical plane through it. On the opposite side of the longitudinal axis 4 there is provided a second tank 2 which is also provided in such a manner that its centre of gravity is constantly at a distance A from the longitudinal axis 4. These tanks 1, 2 constitute a first tank pair.

In the platform there is further provided a third tank 3, which is similarly arranged in such a manner that its centre of gravity is constantly located at a distance B from the centre of gravity of the second tank 2 and at a distance A from the longitudinal axis 4. The second and the third tanks 2 and 3 respectively constitute a second tank pair.

Between the tanks 1, 2 of the first tank pair there is provided a first and a second flow control set 11 and 12 respectively, which are coupled parallel to each other, and between the tanks 2, 3 of the second tank pair there is provided a third and a fourth flow control set 13 and 14 respectively, which are coupled parallel to each other.

The first and the second flow control sets 11 and 12 are connected to the first tank 1 and the second tank 2 via pipes 20 and 22 respectively, and the third and the fourth flow control sets 13, 14 are connected to the second tank 2 and the third tank 3 via pipes 24 and 26.

Each flow control set 11, 12, 13, 14 comprises components which are identical with or have the same function as corresponding components of the other flow control sets, and the flow control sets are constructed in the same way. However, the first and the third flow sets 11 and 13 respectively are arranged to permit flow only in the direction towards the second tank 2, while the second and the fourth flow sets 12 and 14 respectively are arranged to permit flow only in the direction from the second tank 2.

The components of the flow sets will now be described with reference to the second flow set 12 which permits flow only away from the second tank 2.

From the pipe 22 there extend two branch pipes 28, 30 to the intake of respective pumps 32, 34 which are arranged to pump a fluid such as sea water from the second tank 2 to the first tank 1. The pumps' outlet is connected to respective one-way valves 36, 38 which permit flow only away from the second tank 2. The outlet from the two one-way valves 36, 38 is connected to a pipe 40 in which there are coupled in series two shut-off and control valves 42, 44. The outlet from the downstream-arranged shut-off valve 44 is connected to the pipe 20 which connects the first and the second flow control sets 11, 12 with the first tank 1. The reason for providing pairs of pumps, one-way valves and shut-off and control valves is the requirement for the device to be able to function despite a possible failure of one of the components of the pair.

Figure 1:
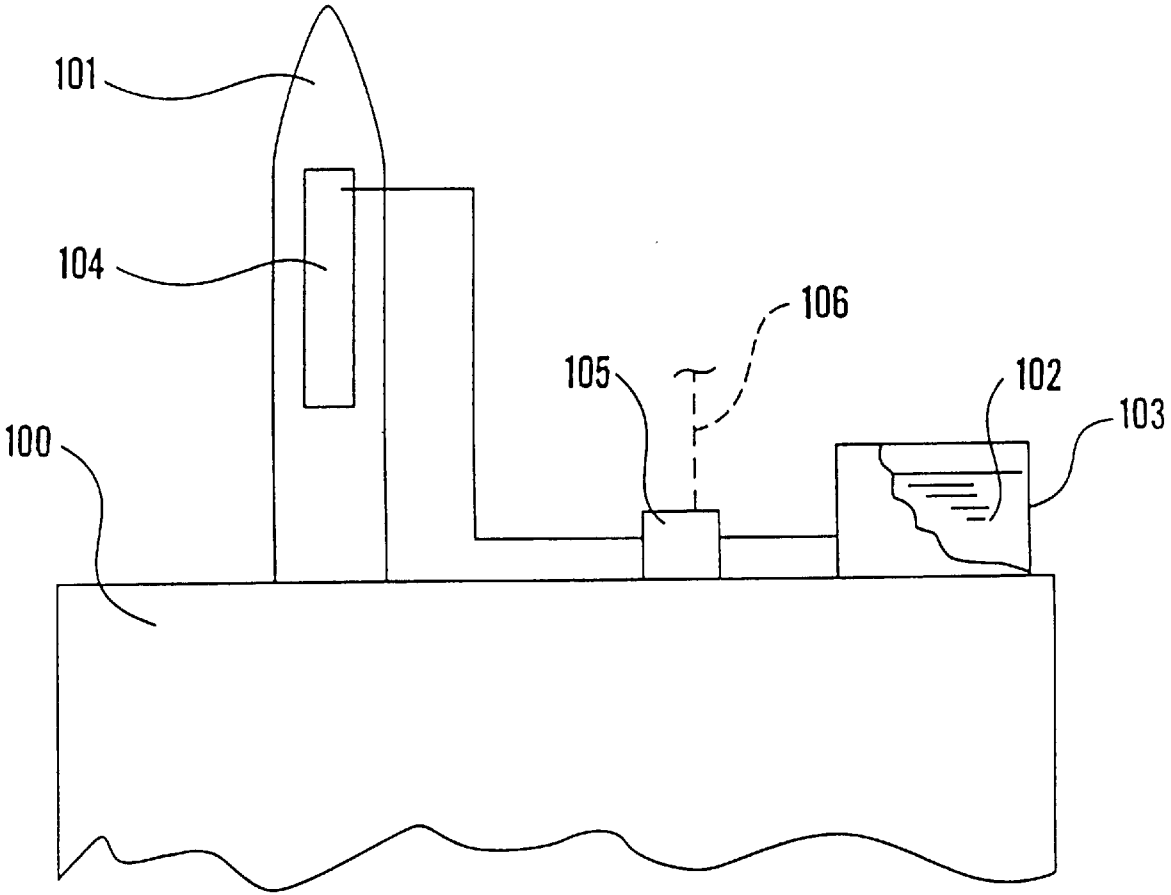
FIG. 1 PRIOR ART
FIG. 1 is a schematic view illustratng a conventional semi-submersible platform.

For control of a flow of water to and from the tanks 1, 2, 3, the device includes a control device 50 which may be composed of a programmable logic control device. This can be arranged for control of the operation of the pumps 32, 34 and the shut-off valves 42, 44 for each of the flow control sets 11, 12, 13, 14, as indicated by broken lines extending between some of these components. In addition, a control wire 116 may be connected to the electrical conduit 106, as illustrated in FIG. 1, for controlling the supply of fuel, i.e. first masses, pumped to a rocket prior to launching.

The device may include flow meters 56, 58, a level gauge 52 in each tank and inclinometers 54.

The control device 50 may be arranged to initiate a pumping of water from at least one of the tanks to at least one of the other tanks on receiving an impulse concerning initiation of, e.g., pumping of fuels to the rocket from tanks (not shown) in the platform, the characteristics of this fuel pumping, such as pumped volume as a function of time, the fuels' specific weight as a function of the temperature etc. being established in advance or measured and communicated to the control device before the pumping is initiated.

Alternatively, the control device 50 can control the initiation and implementation of the pumping of both the fuels and the water.

During the fuel pumping water is transported in a suitable manner between the tanks 1, 2, 3 in such a fashion that an alteration of the fuels' static moment about the platform's centre of gravity as a result of the fuel transport, is continuously and completely counteracted by the alteration in the water's static moment about this centre of gravity which is obtained by the water pumping. The platform's position can thereby be maintained during the fuel pumping, since the device is not based on the premise that a heeling of the platform first has to be established before a counteraction of this heeling can be initiated. The above-mentioned level gauges and inclinometers are hereby intended to give feedback to an operator of the device in order to permit a correction to be made as a result of an error in input data.

A device as described above can also be employed for other sea-going vessels where there is a requirement for the vessel's position to be maintained during movement of a mass thereon.

Even though a device is described above with tanks whose centre of gravity during filling is constantly located at predetermined distances from reference axes, it will be understood that a heeling of the vessel can also be avoided in the case of tanks whose centre of gravity is shifted in relation to the reference axes, as long as the vessel's center of gravity can be kept steady during a suitable filling of the tanks controlled by the control device or by the use of further tanks. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for counteracting heeling of a vessel due to a movement of first masses on the vessel, by means of movement of second masses thereon, which movements create respective static moments about the vessel's center of gravity, where the first masses are composed of fuel which is pumped from tanks in the vessel to respective tanks of a rocket which is carried by the vessel, comprising:

performing the movement of the second masses synchronously with the movement of the first masses;

the static moment generated by the movement of the second masses continuously and completely counteracting the static movement as a result of the movement of the first masses.

2. The method according to claim 1, wherein the second masses are composed of water and the movement of the water is performed by the water being pumped from one tank to another.

3. A device for counteracting heeling of a sea-going vessel due to a movement of first masses on the vessel, by means of movement of second masses thereon, which movements create respective static moments about the vessel's center of gravity, where the first masses are composed of fuel which is pumped from tanks in the vessel to respective tanks of a rocket which is carried by the vessel, comprising:

a control device for co-operating with a first device for movement of the first masses, and for controlling a second device for movement of the second masses;

said control device when controlling the movement of the second masses continuously creating a static moment which completely counteracts the static moment as a result of the movement of the first masses.

4. The device according to claim 3, wherein the control device is a programmable logic control unit, which is arranged to receive an impulse at the starting point for the movement of the first masses and simultaneously start and control the movement of the second masses, the progress of the movement of the first masses being established in advance.

5. The device according to claim 3, wherein the control device is a programmable logic control unit which is arranged to control the progress of the movement of the first as well as the second masses.

* * * * *